US010280934B2

(12) United States Patent
Humhauser et al.

(10) Patent No.: US 10,280,934 B2
(45) Date of Patent: May 7, 2019

(54) GAS TURBINE COMPRESSOR STAGE

(71) Applicant: MTU Aero Engines AG, Munich (DE)

(72) Inventors: Werner Humhauser, Moosburg (DE); Roland Matzgeller, Vierkirchen (DE)

(73) Assignee: MTU Aero Engines AG, Munich (DE)

( * ) Notice: Subject to any disclaimer, the term of this patent is extended or adjusted under 35 U.S.C. 154(b) by 475 days.

(21) Appl. No.: 15/245,388

(22) Filed: Aug. 24, 2016

(65) Prior Publication Data

US 2017/0074271 A1 Mar. 16, 2017

(30) Foreign Application Priority Data

Sep. 16, 2015 (EP) ..... 15185447

(51) Int. Cl.
*F04D 19/02* (2006.01)
*F04D 29/32* (2006.01)
*F04D 29/54* (2006.01)

(52) U.S. Cl.
CPC ..... *F04D 29/324* (2013.01); *F04D 19/028* (2013.01); *F04D 29/544* (2013.01); *F05B 2220/303* (2013.01); *F05D 2220/323* (2013.01); *F05D 2250/70* (2013.01)

(58) Field of Classification Search
None
See application file for complete search history.

(56) References Cited

U.S. PATENT DOCUMENTS 2,406,126 A * 8/1946 Zweifel ..... F04D 19/028 415/194
2,605,956 A * 8/1952 Gardiner ..... F04D 19/028 415/192
2,726,806 A * 12/1955 Henry ..... F04D 19/028 415/194
2,749,027 A * 6/1956 Stalker ..... F04D 19/028 415/144
2,830,754 A * 4/1958 Stalker ..... F04D 19/028 415/144
2,846,136 A * 8/1958 Tadeusz ..... F04D 19/028 415/194
2,846,137 A * 8/1958 Smith, Jr. ..... F01D 5/143 415/194
2,990,106 A * 6/1961 Morton et al. ..... F01D 5/143 415/194
3,285,567 A * 11/1966 Richardson et al. ..... F01D 17/162 415/148

(Continued)

OTHER PUBLICATIONS

H. Grieb: Configuration of Turbo Aero Engines, Nov. 22, 2012 (Nov. 22, 2012), Birkhauser, XP002755942, pp. 182-213.

*Primary Examiner* — Jason D Shanske
*Assistant Examiner* — Theodore C Ribadeneyra
(74) *Attorney, Agent, or Firm* — Barlow, Josephs & Holmes, Ltd.

(57) ABSTRACT

The present invention relates to a compressor stage for a gas turbine, in particular, an aircraft engine, having a row of rotating blades (3) and a row of guide vanes (4), which is adjacent downstream, wherein the choke point σ and the aspect ratio $AR_{ax}$, which is defined by the quotient between average channel height (h) and average chord length ($l_{ax}$), satisfy the condition $$\sigma > -1.33 \cdot AR_{ax} + 5.16.$$

10 Claims, 1 Drawing Sheet

(56) References Cited

U.S. PATENT DOCUMENTS

Figure 1:
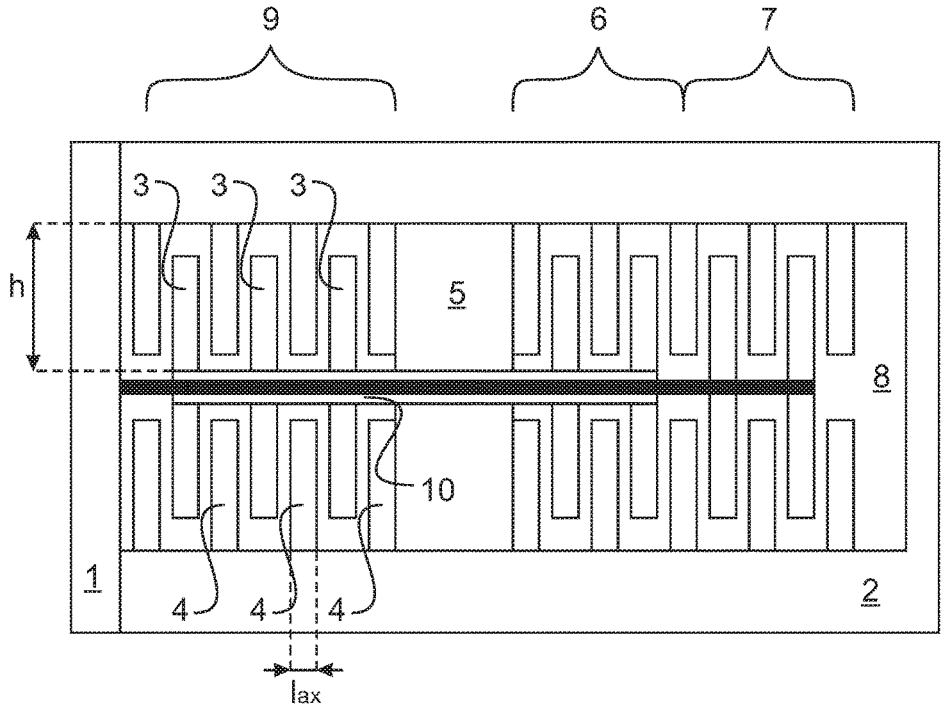

| | | | | | |
|---|---|---|---|---|---|
| 3,775,023 | A * | 11/1973 | Davis | F01D 5/143 | 415/143 |
| 4,011,028 | A * | 3/1977 | Borsuk | F04D 19/028 | 415/192 |
| 4,116,584 | A * | 9/1978 | Bammert | F04D 19/028 | 415/199.5 |
| 2008/0131272 | A1* | 6/2008 | Wood | F01D 5/142 | 415/199.5 |
| 2009/0232636 | A1* | 9/2009 | Grauer | F01D 5/145 | 415/58.5 |
| 2010/0260609 | A1* | 10/2010 | Wood | F01D 5/141 | 416/223 R |
| 2013/0121807 | A1* | 5/2013 | Micheli | F04D 19/028 | 415/58.7 |
| 2013/0156578 | A1* | 6/2013 | Little | F04D 29/164 | 416/31 |
| 2013/0183136 | A1* | 7/2013 | Roberge | F02K 3/075 | 415/1 |
| 2013/0192198 | A1* | 8/2013 | Brilliant | F02K 3/04 | 60/226.1 |
| 2015/0030438 | A1* | 1/2015 | Takahashi | F04D 29/083 | 415/159 |
| 2015/0211546 | A1* | 7/2015 | Heikurinen | F01D 5/143 | 415/1 |
| 2016/0052621 | A1* | 2/2016 | Ireland | B64C 21/04 | 137/13 |
| 2016/0084265 | A1* | 3/2016 | Yu | F04D 29/542 | 415/1 |

* cited by examiner

GAS TURBINE COMPRESSOR STAGE

BACKGROUND OF THE INVENTION

The present invention relates to a compressor stage for a gas turbine, a gas turbine having at least one such compressor stage, an aircraft engine having such a gas turbine, as well as a method for designing such a compressor stage and a method for designing a compressor of such a gas turbine, in particular, an aircraft engine.

Previously, compressor stages of gas turbines have been designed such that their choke point $\sigma$ is always smaller than 5.16 minus 1.33 times the aspect ratio $AR_{ax}$, which is defined by the quotient between the average channel height h and the average chord length $l_{ax}$ ($\sigma \leq -1.33 \cdot AR_{ax}+5.16$).

The desire for reducing fuel consumption, in particular, however, increasingly leads to geometrically small compressors with high efficiency and high aerodynamic and mechanical load with short structural length.

SUMMARY OF THE INVENTION

An object of an embodiment of the present invention is to improve a gas turbine.

This object is achieved by a compressor stage and method of the present invention. The present invention also provides a gas turbine having a compressor stage as described herein, an aircraft engine having a gas turbine as described herein, and a method for designing a compressor of a gas turbine as described herein, in particular, an aircraft engine gas turbine. Advantageous embodiments of the invention are set forth in detail below.

According to one aspect of the present invention, one or more compressor stages of a compressor or each of one or more compressor stages of several compressors of a gas turbine, in particular an aircraft engine gas turbine, (each of) which has a row of rotating blades and a row of guide vanes is aerodynamically designed such that the choke point $\sigma$ and the aspect ratio $AR_{ax}$, which is defined by the quotient between average channel height h and average chord length $l_{ax}$ (in each case), satisfy the condition $$\sigma > -1.33 \cdot AR_{ax}+5.16.$$

Correspondingly, according to one aspect of the present invention, one or more compressor stages for a compressor or one or more compressor stages for several compressors of a gas turbine, in particular, an aircraft engine gas turbine, in particular, one or more compressor stages of one compressor or one or more compressor stages of several compressors of a gas turbine, in particular, an aircraft engine gas turbine, each of which has a row of rotating blades and a row of guide vanes, (in each case) satisfies the condition $$\sigma > -1.33 \cdot AR_{ax}+5.16,$$

with the choke point $\sigma$ and with the aspect ratio $AR_{ax}$, which is defined by the quotient between average channel height h and average chord length $l_{ax}$.

It has surprisingly been found that these compressor stages or compressor stages of this design type, when compared to previously known compressor stages or designs with the same aerodynamic load and number of stages, reduce the structural length and weight of a compressor, or, with the same structural length, increase the efficiency of the compressor and thus the specific fuel consumption can be reduced in this way in each case.

In one embodiment, a row of rotating blades has a plurality of rotating blades distanced in the peripheral direction, these blades being disposed on a rotor, which is (mounted) rotatably around a principal or engine axis, in particular, via a turbine of the gas turbine. The rotating blades can be fastened detachably or cohesively to the rotor or can be designed integrally with the latter. In one embodiment, they may be without a shroud or they may have a closed outer shroud.

In one embodiment, a row of guide vanes has a plurality of guide vanes distanced in the peripheral direction, these vanes being fixed or adjustably disposed on a housing that surrounds the rotor. In one embodiment, they may be without a shroud or they may have a closed inner shroud.

In one embodiment, the row of guide vanes is a row of guide vanes adjacent downstream or is arranged adjacent downstream to the row of rotating blades. In particular, it can be a so-called downstream stator for the conversion of air flowing through kinetically, which is impressed by the rotating row of rotating blades, into pressure energy by the gas turbine.

In one embodiment, the compressor stage is composed of the row of rotating blades and the row of guide vanes in the sense of the present invention.

The choke point $\sigma$ is defined in the usual way in the art as the quotient of the pressure point $\psi_{(eff)}$ divided by the square of the delivery point $\varphi$:

$$\sigma=\psi_{(eff)}/\varphi^2.$$

The pressure point $\psi_{(eff)}$ is defined in the usual way in the art as the quotient of two times the specific work $H_{(eff)}$ of the stage or of the row of rotating blades divided by the square of the peripheral velocity at the inlet to the stage or to the row of rotating blades $u_1$.

$$\psi_{(eff)}=2 \cdot H_{(eff)}/u_1^2.$$

The delivery point $\varphi$ is defined in the usual way in the art as the quotient of the axial absolute velocity $c_{ax}$, in particular, at the inlet to the stage or to the row of rotating blades ($c_{ax,\ 1}$), divided by the peripheral velocity at the inlet to the stage or to the row of rotating blades $u_1$.

$$\varphi=c_{ax(,1)}/u_1.$$

The choke point $\sigma$ is thus defined in a similar way as the quotient of two times the specific work $H_{(eff)}$ of the stage or of the row of rotating blades divided by the square of the axial absolute velocity $c_{ax}$, in particular, at the inlet to the stage or to the row of rotating blades ($c_{ax,\ 1}$):

$$\sigma=2 \cdot H_{(eff)}/c_{ax(,1)}^2.$$

The average channel height h is defined in the usual way in the art as the geometric mean of half the difference(s) between the outer and/or inner diameters $D_a$, $D_i$ of the flow channel of the compressor stage or of the row of rotating blades:

$$h=(D_a-D)/2.$$

The average chord length $l_{ax}$ is defined in the usual way in the art as the geometric mean of the distance between leading and trailing edges of the row of rotating blades or of the compressor stage.

Correspondingly, the aspect ratio $AR_{ax}$ results as:

$$AR_{ax}=h/l_{ax}.$$

According to one embodiment, the aspect ratio $AR_{ax}$ is greater than 0.5. Additionally or alternatively, according to one embodiment, the aspect ratio $AR_{ax}$ is smaller than 2.5. A particularly advantageous compressor stage can be provided in this way.

According to one embodiment, a total pressure ratio Π of one or more compressor(s) amounts to at least 40, in particular, at least 45. An especially advantageous compressor can be provided in this way.

The total pressure ratio Π is defined in the usual way in the art as the quotient between the pressure $p_2$ at the outlet of the compressor and the pressure $p_1$ at the inlet of the compressor:

$$\Pi=p_2/p_1.$$

According to one embodiment, a by-pass ratio BPR (By-Pass-Ratio) of the aircraft engine amounts to at least 10, in particular, at least 12. An especially advantageous aircraft engine can be provided in this way.

The by-pass ratio BPR is defined in the usual way in the art as the quotient between the mass air flow $m_{by\text{-}pass}$, which is guided past downstream to a fan external to the gas turbine of the aircraft engine (by-pass flow), divided by the mass air flow $m_{core}$, which passes inside the combustion chamber of the gas turbine and provides the shaft power (core flow):

$$\mathrm{BPR}=m_{by\text{-}pass}/m_{core}.$$

Reference is made also to H. Grieb, in particular, relative to the above, as defined in the usual way in the art, and therefore the values known to the person skilled in the art: "Verdichter für Turbo-Flugtriebwerke" ("Compressors for turbo-aircraft engines"), Springer Publishers, ISBN 978-3-540-34373-8.

BRIEF DESCRIPTION OF THE DRAWING FIGURES

Figure 2:
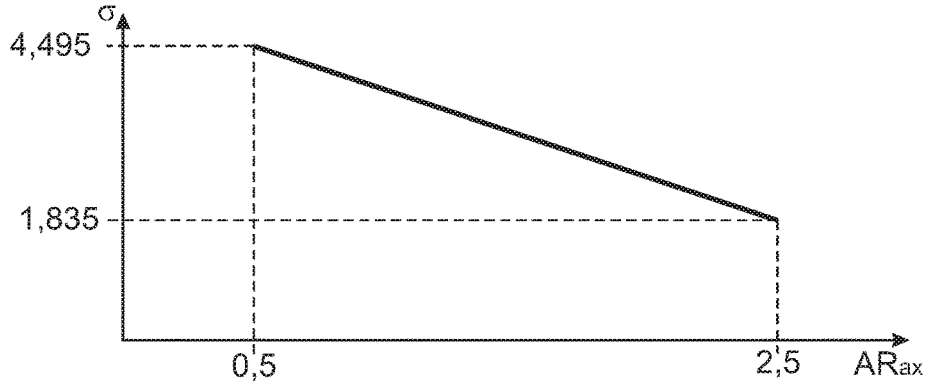

Additional advantageous enhancements of the present invention can be taken from the dependent claims and the following description of preferred embodiments. For this purpose and partially schematized:

FIG. 1 shows an aircraft engine having a gas turbine with a compressor having several compressor stages according to an embodiment of the present invention; and FIG. 2 shows a boundary curve for designing the compressor stages according to an embodiment of the present invention.

DESCRIPTION OF THE INVENTION

FIG. 1 shows in partially schematized form an aircraft engine with a fan 1 and a gas turbine, which, simply for a more compact illustration and as an example, has only one compressor 9, a downstream combustion chamber 5, a high-pressure turbine 6, which is coupled with the compressor 9 via a rotor 10, and a low-pressure turbine 7, which is coupled with the fan 1. A core flow 8 flows through the gas turbine and a by-pass flow 2 flows around the gas turbine.

The compressor 9 has several compressor stages, each of which has a row of rotating blades 3 fastened to the rotor and a row of guide vanes 4 adjacent downstream.

One or more of these compressor stages 3, 4 is or are designed such that the choke point σ and the aspect ratio $AR_{ax}$, which is defined by the quotient between average channel height h and average chord length $l_{ax}$, satisfy the condition $$\sigma>-1.33\cdot AR_{ax}+5.16;$$

the aspect ratio $AR_{ax}$ is greater than 0.5 and less than 2.5.

The total pressure ratio Π of the compressor 9 amounts to at least 45; the by-pass ratio BPR of the aircraft engine is at least 12.

FIG. 2 shows a boundary curve for designing the compressor stages according to an embodiment of the present invention. These will be or are designed such that the choke point σ lies above the boundary curve $\sigma=-1.33\cdot AR_{ax}+5.16$, which is depicted by the bold line in FIG. 2.

Although exemplary embodiments were explained in the preceding description, it shall be noted that a plurality of modifications is possible.

Thus, the aircraft engine or the gas turbine may have, in particular, a low-pressure compressor and a downstream high-pressure compressor; in an enhancement, there is also an intermediate compressor disposed therebetween; whereby at least one of these compressors can be or will be able to be designed in the way explained in the preceding example with reference to compressor 9. Likewise, the low-pressure and high-pressure compressors can also be understood as a compressor in the sense of the present invention.

The fan 1 can be coupled to the high-pressure turbine 6, in particular, via a gearing or drive.

In addition, it shall be noted that the exemplary embodiments only involve examples that in no way shall limit the scope of protection, the applications and the construction. Rather, a guide is given to the person skilled in the art by the preceding description for implementing at least one exemplary embodiment, whereby diverse modifications, particularly with respect to the function and arrangement of the described components, can be carried out without departing from the scope of protection, as it results from the claims and combinations of features equivalent to these.

What is claimed is:

1. A compressor stage for a gas turbine aircraft engine, having a row of rotating blades and a row of guide vanes, which is adjacent downstream, wherein the choke point σ and the aspect ratio $AR_{ax}$, which is defined by the quotient between average channel height and average chord length, satisfy the condition $$\sigma>-1.33\cdot AR_{ax}+5.16.$$

2. The compressor stage according to claim 1, wherein the aspect ratio $AR_{ax}$ is greater than 0.5 and less than 2.5.

3. The compressor stage according to claim 1, wherein the compressor stage is configured and arranged in a gas turbine having at least one compressor.

4. The compressor stage according to claim 1, wherein a total pressure ratio Π of at least one of the compressors amounts to at least 40.

5. The compressor stage according to claim 1, wherein the compressor stage is configured and arranged in an aircraft engine having a gas turbine.

6. The compressor stage according to claim 1, wherein a by-pass ratio BPR of the aircraft engine is at least 10.

7. A method for configuring at least one compressor stage of at least one compressor of a gas turbine aircraft engine, having a row of rotating blades and a row of guide vanes, which is adjacent downstream, comprising the step of:

aerodynamically configuring the compressor stage so that the choke point σ and the aspect ratio $AR_{ax}$, which is defined by the quotient between average channel height and average chord length, satisfy the condition $$\sigma>-1.33AR_{ax}+5.16.$$

8. The method according to claim 7, wherein at least one compressor stage of the compressor is configured.

9. The method according to claim 8, wherein a total pressure ratio Π of the compressor amounts to at least 40.

10. The method according to claim 7, wherein a by-pass ratio BPR of the aircraft engine amounts to at least 10.

* * * * *